US005536064A

United States Patent [19]

MacLean

[11] Patent Number: 5,536,064

[45] Date of Patent: Jul. 16, 1996

[54] COMBINATION BACKPACK AND CHAIR

[76] Inventor: Shian MacLean, 7027 Dublin Blvd., Dublin, Calif. 94568

[21] Appl. No.: 409,752

[22] Filed: Mar. 24, 1995

[51] Int. Cl.[6] ..... A47C 5/10

[52] U.S. Cl. ..... 297/129; 224/155

[58] Field of Search ..... 297/129; 224/155, 224/211, 212

[56] References Cited

U.S. PATENT DOCUMENTS

| | | | |
|---|---|---|---|
| 2,922,465 | 1/1960 | Johansson et al. | 224/155 |
| 3,250,449 | 5/1966 | Woodman | 224/9 |
| 3,734,366 | 5/1973 | Wood | 224/212 |
| 4,487,345 | 12/1984 | Pierce et al. | 224/155 |
| 4,577,901 | 3/1986 | Phillips | 297/17 |
| 4,676,548 | 6/1987 | Bradbury | 297/129 |
| 4,718,715 | 1/1988 | Ho | 297/32 |
| 4,720,029 | 1/1988 | Varanakis | 224/155 |
| 5,265,780 | 11/1993 | Matthews | 224/155 |
| 5,297,708 | 3/1994 | Carpenter | 224/155 |
| 5,381,941 | 1/1995 | Brune | 224/155 |
| 5,409,291 | 4/1995 | Lamb et al. | 297/129 |

*Primary Examiner*—Peter R. Brown

[57] ABSTRACT

A pack frame that is convertible to a chair, having a generally rectangular shaped back section which has fittings that allow a back pack to be attached to it, and a generally rectangular shaped seat section pivotally connected to the back section. The back and seat sections have fabric or plastic panels attached to each respectively that form the back and seat of the chair. Two adjustable shoulder straps are each attached at one end to the front of the chair seat and at the other end to the lower portion of the rear leg member of the chair. A padded hip belt is attached to the front leg member. Back pads are attached to the bottom of the seat section and to the front leg section, and the back pads extend approximately one inch or more from the bottom of the seat section and the front of the front leg section, respectively, whereby the folding chair is held away from the user's body so that only the padded shoulder straps, the back pads, and a padded hip belt come in contact with the user's body. Retaining clips hold the front and rear legs together when the combination pack frame and chair is in the pack frame position. The invention can be used with a back pack attached to the back section of the chair, or it can be used without any back pack, as a means of carrying a folding chair.

3 Claims, 2 Drawing Sheets

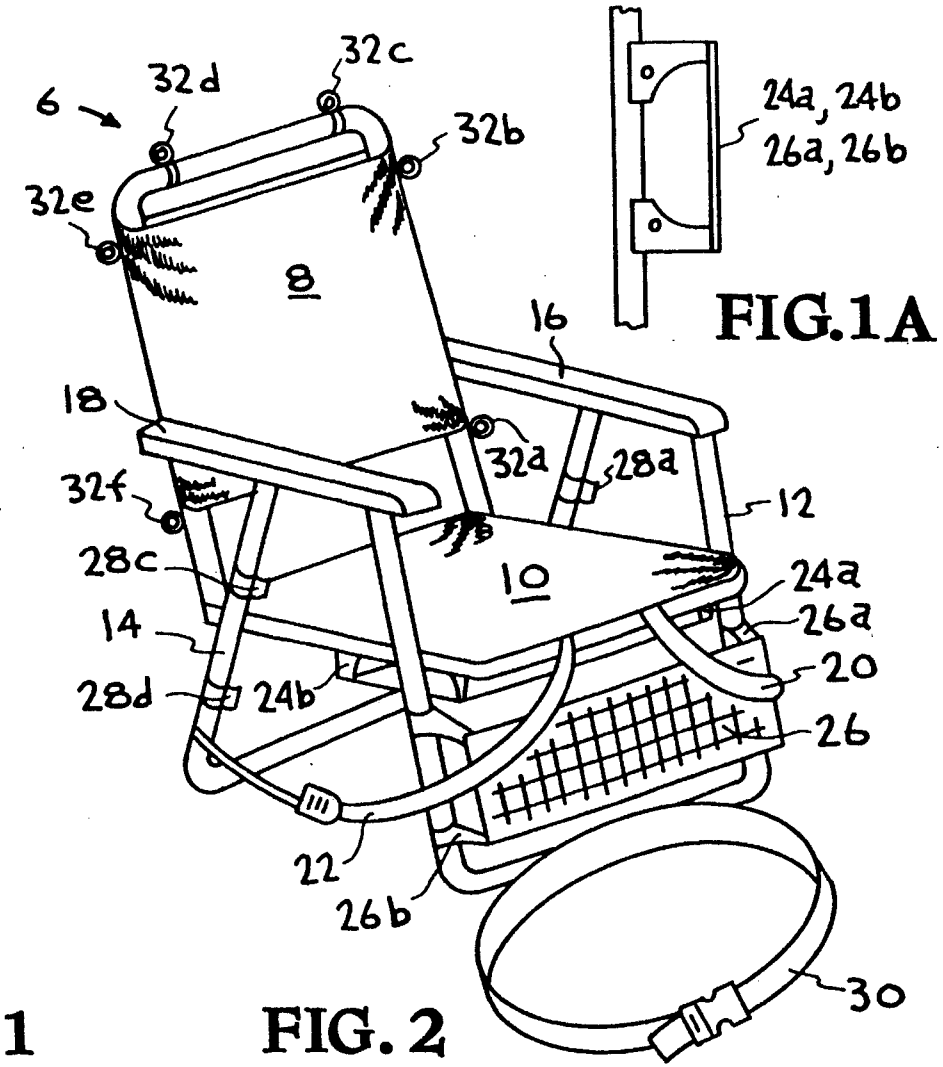
FIG. 1A
FIG. 2
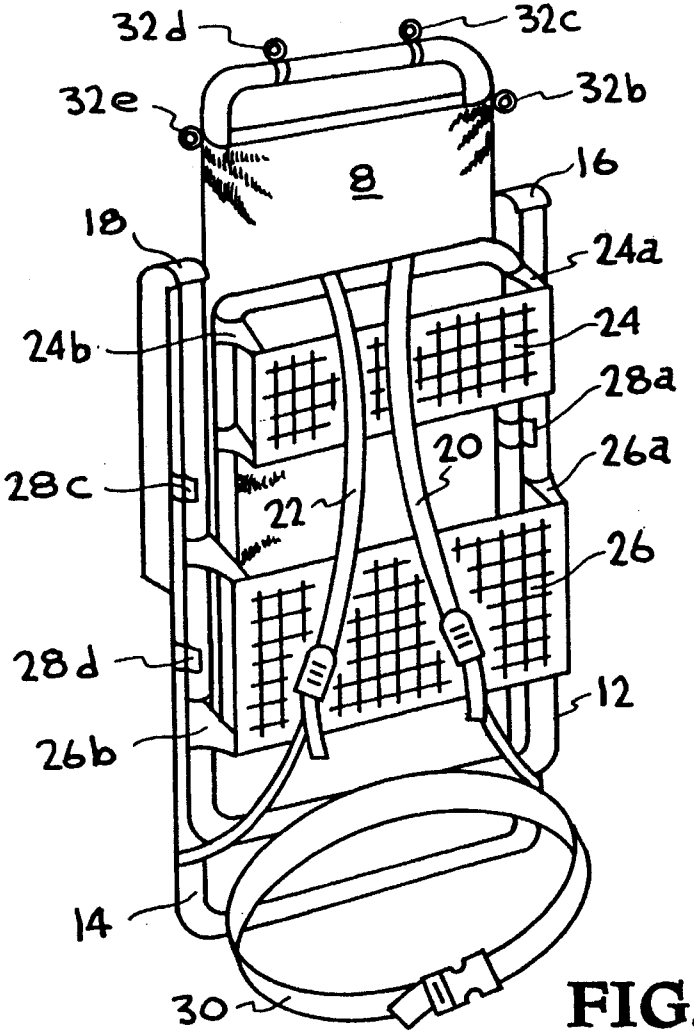
FIG. 1

COMBINATION BACKPACK AND CHAIR

BACKGROUND

1. Field of Invention

This invention relates to a combination backpack and chair.

2. Description of Prior Art

Backpacks are used to distribute the weight of a pack and its contents comfortably to the user's shoulders, back and hips. A pack frame distributes the weight and also allows ventilation between the pack and the user's back and shoulders, which contributes to the comfort of the user.

Backpacks and pack frames are designed to be lightweight and strong and to allow the user to carry a loaded pack comfortably by means of attached padded shoulder straps, padded hip belts, and ventilated back pads, which are designed to hold the metal pack frame members away from the user's body so that they do not rub against the user's backbone, neck, hips or shoulders. The ventilated mesh fabric pads that come in contact with the user's back provide ventilation between the pack frame and the user's back. A well designed pack frame is designed so that only the padded shoulder straps, ventilated back pads and padded hip belt come in contact with the user's body.

Folding chairs, usually made of aluminum tubing or other lightweight metal tubing, with fabric or vinyl seats and backs are also designed to be lightweight, strong and comfortable.

Devices of prior art consisting of back packs or back pack frames that convert to a folding chair have resulted in compromises that are either not comfortable or practical when used as a backpack or pack frame, or not comfortable or practical when used as a chair, or not comfortable or practical in either usage.

For example, U.S. Pat. No. 4,676,548 to Bradbury (1987) and U.S. Pat. No. 4,487,345 to Pierce and Merrill (1984) each present a combination folding chair and backpack which when folded into position to be used as a backpack, has tubular metal or wooden members, including the bottom of the chair legs and the front of the chair seat, that will rub uncomfortably against the user's backbone, neck and hips.

The above mentioned prior art devices are not designed to hold the metal parts of the pack frame away from the user's body in order to make them comfortable to use as back packs.

The above mentioned prior art devices have not solved the problem of designing a device that will lock up into a rigid frame when it is to be used as a back pack frame and yet is easily unfolded into a chair. U.S. Pat. No. 4,676,548 to Bradbury (1987) describes a device that has to be fastened together with two separate pairs of straps that connect the tubular member forming the top of the chair back and the tubular member forming the front of the chair seat, and each pair of straps has to be fastened together by means of buckles.

The above mentioned prior art devices have the appearance of being uncomfortable and awkward to use as pack frames or back packs, and therefore do not have commercial appeal.

The invention described in U.S. Pat. No. 4,676,548 to Bradbury (1987) has a number of disadvantages:

(a) The member that forms the bottom of the front legs will rub against the user's hips or backbone when used as a pack frame.

(b) The member that forms the front of the seat will rub against the backbone, neck or shoulders of the user when used as a pack frame.

(c) When folded up into a backpack the invention does not lock together easily into a rigid pack frame. The user would have to manually fasten two sets of straps together to hold the device in position as a backpack.

(d) The invention does not unfold into a full size chair that would be comfortable for the average adult, but instead has very short legs and is not high enough to be comfortable.

(e) It requires a low back so that when the device is folded into position as a chair, the top of the back and the front of the seat will be adjacent to each other so that they can be fastened together by means of straps.

(f) It has no padded hipbelts or ventilated backpad to provide comfortable support when used as a backpack.

OBJECTS AND ADVANTAGES

Accordingly, several objects and advantages of my invention are:

(a) to provide a combination backpack and chair that is comfortable for use as a backpack and also comfortable for use as a chair;

(b) to provide a combination backpack and chair that locks together easily into a rigid frame when folded up;

(c) to provide a combination backpack and chair that has all the comfortable features of a well-designed backpack or pack frame, including a unique design that holds the combination pack frame and chair away from the user's back, shoulders and neck, so that only the padded hip belt, shoulder straps and ventilated back pads come in contact with the users's body;

(d) to provide a combination backpack and chair, which when used as a chair, is sturdy and comfortable and can be used on most types of terrain, including sand or soft ground;

(e) to provide a combination backpack and chair which when used as a chair will hold an attached pack in an upright position for convenient access to the pack;

(f) to provide a combination backpack and chair that can be manufactured easily and economically;

(g) to provide a packframe that will support a variety of types and sizes of backpacks;

(h) to provide a combination pack frame and chair which has the appearance of a pack frame when it is folded into position to be used as a pack frame, so that it will be obvious to a person looking at the invention that it will be comfortable in use as a pack frame, and thus will have commercial appeal;

(i) to provide a chair that can be folded up and carried on a person's back, with no additional backpack being attached to it;

(j) to provide a combination backpack and chair that is greatly improved over any previously disclosed combination backpack and chair by combining all of the following elements for the comfort and convenience of the user: specially designed ventilated back pads to hold the combination pack frame and chair away from the user's back, shoulders and hips when the combination backpack and chair is carried as a backpack; padded shoulder straps; a padded hipbelt to help support the weight of the backpack and its contents; a combination backpack and chair designed to lock easily into a compact folded position so that it will not unfold while being used as a backpack; and a combination pack frame and chair that will support a heavy pack upright for the convenience of the user when it is in the chair position;

(k) to provide a combination backpack and chair that can be manufactured from a standard aluminum folding chair.

Other objects and advantages of the present invention will become apparent from a consideration of the drawings and ensuing description.

BRIEF DESCRIPTION OF THE DRAWINGS

FIG. 1 is the combination pack frame and chair shown in the preferred embodiment with ventilated back pads of mesh fabric, shown in the position to be carried as a pack frame.

FIG. 1*a* is a detailed drawing of a bracket which is used to attach each end of the ventilated back pad to the combination pack frame and chair.

FIG. 2 is the combination pack frame and chair shown in the preferred embodiment with ventilated fabric mesh back pads, shown in the position as a chair.

REFERENCE NUMBERS IN DRAWINGS

6 folding chair

8 back section

10 seat section

12 front leg section

14 rear leg section

16 left armrest

18 right armrest

20 left shoulder strap

22 right shoulder strap

24 upper ventilated back pad

24*a*, 24*b* upper brackets

26 lower ventilated back pad

26*a*, 26*b* lower brackets

28*a*, 28*b*, 28*c*, 28*d* retaining clips

30 padded hipbelt

Figure 4:
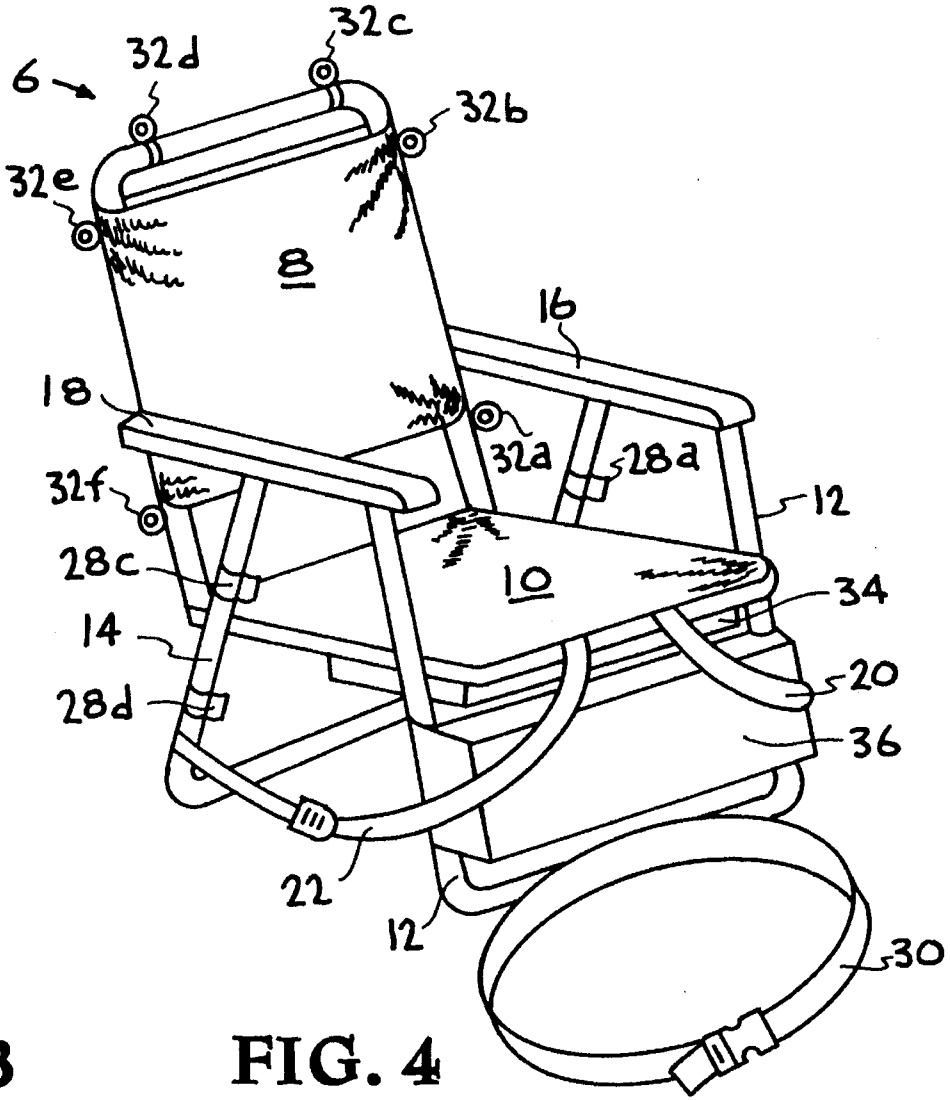
FIG. 4 is an alternate embodiment of the combination backpack and chair, with solid, non-ventilated back pads, shown in the chair position.

32*a*, 32*b*, 32*c*, 32*d*, 32*e*, 32*f* backpack attachment fasteners

34 upper solid back pad

36 lower solid back pad

DESCRIPTION—FIGS. 1, 1*a* AND 2

The preferred embodiment of the present invention is illustrated in FIGS. 1 and 2.

FIG. 1 shows the combination packframe and folding chair in the pack frame position. A folding chair 6 constructed of aluminum tubing and fabric seat and back panels has a back section 8 and a seat section 10, pivotally connected to each other, a u-shaped front leg section 12 pivotally connected to seat section 10, a u-shaped rear leg section 14 pivotally connected to seat section 10, a left armrest 16 and right armrest 18, each pivotally connected to back section 8 and to the ends of front leg section 12 and rear leg section 14.

Adjustable shoulder straps 20 and 22 are each attached at one end to seat section 10 and at the other end to rear leg section 14.

Upper ventilated back pad 24 is constructed of a mesh fabric that provides ventilation when it rests against the user's back, and is attached to the underside of seat section 10 by means of brackets 24*a* and 24*b* which hold upper ventilated back pad 24 away from seat section 10 approximately one inch or more in order to keep the metal sections of the chair from coming in contact with the user's body when the combination pack frame and chair is carried on a person's back.

Lower ventilated back pad 26 is constructed of a mesh fabric that provides ventilation when it rests against the user's back, and is attached to the front of front leg section 12 by means of brackets 26*a* and 26*b* which hold lower ventilated back pad 26 away from front leg section 12 approximately one inch or more in order to keep the metal sections of the chair from coming in contact with the user's body when the combination pack frame and chair is carried on a person's back.

Retaining clips 28*a*, 28*b*, 28*c* and 28*d* are attached to rear leg section 14 and clamp onto front leg section 12 in order to hold the combination pack frame and chair in the folded position.

FIG. 2 shows the combination packframe and folding chair in the chair position. When the combination pack frame and folding chair is unfolded into the chair position, retaining clips 28*a*, 28*b*, 28*c* and 28*d* release the front leg section. Retaining clips 28*a*, 28*b*, 28*c* and 28*d* may be made of any material such as plastic or metal that allows them to engage and disengage easily, to help hold rear leg section 14 and front leg section 12 together when the invention is in the packframe position.

As shown in FIG. 1 and FIG. 2, padded hipbelt 30 is attached to front leg section 12 and may be fastened around the user's waist to help support the weight of the pack frame and chair.

Any conventional pack with plurality of compartments may be attached to back section 8, and backpack attachment fasteners 32*a*, 32*b*, 32*c*, 32*d*, 32*e* and 32*f* are attached to or built into back section 8. These attachment fasteners may be any metal or plastic fittings such as are commonly used on backpack frames to attach a backpack.

FIG. 1*a* shows the detail of upper brackets 24*a* and 24*b* and lower brackets 26*a* and 26*b*, which may be made from metal or plastic and fastened to chair 6 by screws or any other method of attachment. Upper brackets 24*a* and 24*b* hold upper ventilated back pad 24 stretched between the brackets and approximately one inch or more away from the underside of seat section 10. Lower brackets 26*a* and 26*b* hold lower ventilated back pad 26 stretched between the brackets and approximately one inch or more away from front leg section 12.

Figure 3:
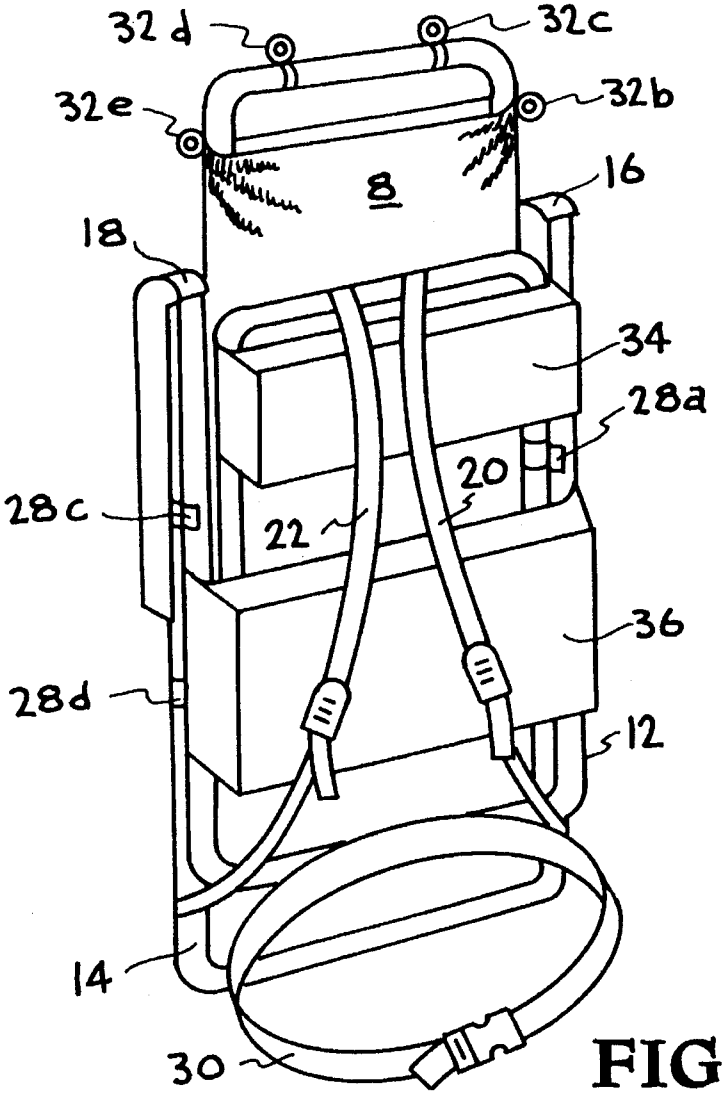
FIG. 3 is the combination pack frame and chair shown in an alternate embodiment, with solid, non-ventilated back pads, shown in the pack frame position.

FIGS. 3 and 4 show an alternate embodiment in which the combination packframe and chair has a solid upper back pad 34 attached directly to the underside of seat section 10 and a solid lower back pad 36 attached directly to the front of front leg section 12. Solid upper back pad 34 extends out from the underside of seat section 10 approximately one inch or more, and solid lower back pad 36 extends out from front leg section 12 approximately one inch or more so that the metal sections of the chair are held away from the user's body when the combination pack frame and chair is carried on a person's back. Solid upper back pad 34 and solid lower back pad 36 may be constructed of any material that is at least one inch thick and will hold the chair away from the body of a person when the person is carrying the combination pack frame and chair in the pack frame position.

In an alternate embodiment, the combination pack frame and chair may be constructed with no attached fasteners for the attachment of a backpack, and may be used as a chair which can be carried as a backpack but without any additional pack attached.

While the invention will be described in connection with a certain preferred embodiment it is to be understood that it is not intended to limit the invention to that particular embodiment. Rather it is intended to cover all alternatives, modifications and equivalents as may be included within the spirit and scope of the invention as defined by the appended claims.

OPERATION—FIGS. 1 AND 2

The manner of changing the combination pack frame and folding chair, in its preferred embodiment, from one position to the other is as follows, starting with the invention in the pack frame position: Standing next to the pack frame the user holds the top of back section 8 with one hand, and the front of seat section 10 with the other hand, and unfolds the combination pack frame and chair into the chair position. Retaining clips 28*a*, 28*b*, 28*c* and 28*d* are designed to release when the invention is unfolded from the packframe position, and to clamp the front and rear leg sections together when the invention is folded into the packframe position.

SUMMARY, RAMIFICATIONS AND SCOPE

The reader will see that the present invention can be conveniently used as a backpack or backpack frame and chair. It has the following additional advantages:

it is comfortable for use both as a backpack or pack frame and as a chair;

it is designed to be sturdy, lightweight and easily constructed;

it is easily converted from pack frame to chair and back again to pack frame;

it can be used to hold a pack upright for the convenience of the user when it is used as a chair;

it is designed so that metal parts of the chair are held away from the user's neck, shoulder and hips;

it is designed to have commercial appeal because it looks like a comfortable pack frame when folded into the pack frame position;

it can be constructed from a standard aluminum folding chair.

Although the description above contains many specificities, these should not be construed as limiting the scope of the invention but as merely providing illustrations of some of the presently preferred embodiments of this invention. For example, the shoulder straps could be attached at different positions, or the clips that hold the leg members together when the invention is used as a pack frame could be designed differently, etc.

Thus the scope of the invention should be determined by the appended claims and their legal equivalents, rather than by the examples given.

I claim:

1. A combination pack frame and folding chair comprising:

(a) a folding chair with: a back section which is generally rectangular and is formed from a tubular metal frame supporting a back panel; a seat section pivotally connected to said back section, wherein said seat section is generally rectangular and is formed from a tubular metal frame supporting a seat panel; a u-shaped front leg section pivotally connected to said seat section; a u-shaped rear leg section pivotally connected to said seat section; a left armrest and a right armrest, each pivotally connected to said back section and to one end of said front leg section and to one end of said rear leg section;

(b) shoulder straps attached at one end to said seat section and at the other end to either side of said rear leg section, whereby said folding chair may be carried on a person's back; a pad attached to the bottom of said seat section and extending out from the bottom of said seat section approximately one inch or more, whereby when said folding chair is folded into a compact position and carried on a person's back, said pad will come in contact with the person's back and will hold said folding chair away from the person's body so that said folding chair will not rub or bump against the person's body; and a padded hip belt attached to said front leg section.

2. A combination pack frame and folding chair comprising:

(a) a folding chair with: a back section which is generally rectangular and is formed from a tubular metal frame supporting a back panel; a seat section pivotally connected to said back section, wherein said seat section is generally rectangular and is formed from a tubular metal frame supporting a seat panel; a u-shaped front leg section pivotally connected to said seat section; a u-shaped rear leg section pivotally connected to said seat section; a left armrest and a right armrest, each pivotally connected to said back section and to one end of said front leg section and to one end of said rear leg section;

(b) shoulder straps attached at one end to said seat section and at the other end to either side of said rear leg section, whereby said folding chair may be carried on a person's back; a pad attached to the front of said front leg section and extending forward from the front of said front leg section approximately one inch or more, whereby when said folding chair is folded into a compact position and carried on a person's back, said pad will come in contact with the person's back and will hold said folding chair away from the person's body so that said folding chair will not rub or bump against the person's body; and a padded hip belt attached to said front leg section.

3. A combination pack frame and folding chair comprising:

(a) a standard aluminum folding chair comprising: a back section with a back panel; a seat section with a seat panel, said seat section being pivotally connected to said back section; a front leg section and a rear leg section each pivotally connected to said seat section; left and right armrests, each pivotally connected to said back section and each pivotally connected to said front leg section and to said rear leg section;

(b) shoulder straps attached at one end to said seat section and at the other end to either side of said rear leg section, whereby said folding chair may be carried on a person's back; an upper pad attached to the underside of said seat section and extending out from the underside of said seat section sufficiently, whereby when said folding chair is folded into a compact position and carried on a person's back, said upper pad will hold said folding chair away from the person's body so that said folding chair will not rub or bump against the person's body; a lower pad attached to the front of said front leg section, said lower pad extending forward from the front of said front leg section sufficiently whereby when said folding chair is folded into a compact position and carried on a person's back, said lower pad will hold said folding chair away from the person's body so that said folding chair will not come in contact with the person's body; and a padded hip belt attached to said front leg section, whereby when said folding chair is carried as a packframe, the weight of said folding chair and any attached backpack may be partially supported by said padded hip belt.

* * * * *